United States Patent [19]

Wernet et al.

[11] 4,136,270

[45] Jan. 23, 1979

[54] ACTUATOR FOR PUSHBUTTON SWITCH

[75] Inventors: William F. Wernet, Huntsville; Raymond H. Anders, Madison, both of Ala.

[73] Assignee: GTE Automatic Electric Laboratories Incorporated, Northlake, Ill.

[21] Appl. No.: 780,888

[22] Filed: Mar. 24, 1977

[51] Int. Cl.[2] ..... H01H 3/12; H01H 13/14

[52] U.S. Cl. ..... 200/340; 200/5 A; 200/295; 200/335; 74/483 PB

[58] Field of Search ..... 222/402.13, 402.15, 222/182, 509; 84/450, 433, 435, 452 P, DIG. 7; 235/145 R; 200/5 A, 5 E, 5 EA, 50 CU, 159 B, 160, 293, 295, 324, 325, 328, 329, 333, 335, 340; 197/98; 361/398; 74/483 PB

[56] References Cited

U.S. PATENT DOCUMENTS

| | | | |
|---|---|---|---|
| 3,205,754 | 9/1965 | Becwar | 84/435 X |
| 3,215,317 | 11/1965 | Abplanalp | 222/509 X |
| 3,257,044 | 6/1966 | Seaquist | 222/402.13 |
| 3,347,423 | 10/1967 | Rahn et al. | 222/402.13 X |
| 3,627,935 | 12/1971 | Spievak | 200/340 X |
| 3,800,104 | 3/1974 | Lien et al. | 200/5 A |
| 3,855,894 | 12/1974 | Thomas et al. | 84/433 X |
| 3,867,591 | 2/1975 | Nordeen | 200/293 X |
| 3,952,175 | 4/1976 | Golbeck et al. | 200/295 X |
| 4,032,729 | 6/1977 | Koistinen | 200/340 X |
| 4,063,056 | 12/1977 | Baker | 200/335 X |

FOREIGN PATENT DOCUMENTS

| | | | |
|---|---|---|---|
| 2459464 | 6/1975 | Fed. Rep. of Germany | 200/159 B |

*Primary Examiner*—Robert S. Ward, Jr.
*Attorney, Agent, or Firm*—Robert J. Black

[57] ABSTRACT

An actuator for pushbutton type switches comprising a single molded plastic unitary structure. The actuator provides for operation of both locking and nonlocking switches and for actuation of switches mounted both parallel to and perpendicular to the plane of operation of the actuator.

9 Claims, 5 Drawing Figures

ACTUATOR FOR PUSHBUTTON SWITCH

BACKGROUND OF THE INVENTION

1. Field of the Invention

The present invention relates to pushbutton switching devices and more particularly to an actuator for use with pushbutton switches mounted internally within a housing, enclosure, etc.

2. Description of the Prior Art

Recent trends in the packaging of electrical and electronic equipment are directed towards the inclusion of all working parts of circuitry within the equipment housing. Even those controls and indicators provided for use with such devices are frequently located internally with those portions of the device that must be accessible for observation or manual operation mounted flush with the enclosure housings exterior surfaces. Such designs are considered more pleasing from an esthetic sense as well as more desirable from a standpoint of operation and maintenance. Because many such electrical and electronic devices incorporate the use of pushbutton switches, special switches are frequently required for flush mounting. Such switches are generally more complex and consequently more expensive than conventional devices, in order to provide for flush mounting.

An alternate technique employed recently within current design trends is the inclusion or mounting of the switching devices internally within the enclosure and the utilization of separate actuators fastened to the housing, which when operated, in turn engage an associated switching device and cause it to operate. Actuators of this type are taught in U.S. Pat. Nos. 3,909,564 and 3,952,175.

Actuator designs found in the above patents which may be considered as typical of the present state of the art, are reasonably complex and consequently provide minimum economy over the use of integrated flush mounted switches of more conventional types. For example, in U.S. Pat. No. 3,952,175 elaborate means are provided for supporting the actuator in a rigid relationship to the switching mechanism to be operated.

Accordingly, it is the object of the present invention to provide a new and improved actuator for switching devices mounted internally to an enclosure wherein the actuator is flush mounted with the exterior surface of the enclosure and is economical to manufacture, simple to operate and adaptable to a number of different forms of switching device.

SUMMARY OF THE INVENTION

In the present invention a one-piece unitary structure of molded plastic is provided. The basic structure consists of three portions a first or mounting section, which is utilized for connecting the actuator mechanism to the enclosure in such a manner as to place the exterior portion of the actuator approximately flush with the exterior surface of the enclosure. A second section which is moveable relative to the enclosure acts as the manually operable portion which may be depressed to operate an associated pushbutton switch. The manually operable portion is connected to the mounting section by a hinge molded into the structure.

Affixed to the opposite end of the operating portion, from the mounting portion, is an extended stop section, which when the actuator is restored, engages a portion of the enclosure, to limit travel of the actuator device beyond its normal restored position.

In one embodiment of the present invention a pushbutton type switch is mounted directly under the actuator in a plane perpendicular to the operating section of the actuator, with the plunger of the associated switching device in direct contact with the actuator underside. In this manner, the manual operation of the actuator is extended directly to the switch plunger causing the associated switch to operate. Assuming the switch to be of the nonlocking type, when manual pressure is removed from the actuator, the normal spring action of the associated pushbutton switching device will restore the actuator to its normal position, with excess travel limited by the stop portion as described above.

In those environments where it is desirable to use the actuator of the present invention with a locking type two-position pushbutton switch, the actuator mechanism is molded in such a manner that the upper surface of the operating section is molded at an angle to the mounting section and in such a manner that the angle is equivalent to that position that the actuator would assume in its operated position for nonlocking type keys. In this manner, the actuator mechanism is normally in contact with the plunger of the associated locking type switching device in the operated position without maintenance of manual pressure and when the switch is again depressed to render the associated switch nonoperated, the spring action of the plunger forces the actuator mechanism up, so that it becomes flush with the mounting enclosure and is held in such position by the spring action of the associated switching device plunger.

In those environments where it is desirable to use the actuator of the present invention with pushbutton type switches that are mounted in a plane parallel to the upper operating surface of the actuator, a cam section projects from the lower side of the actuator operator and stop sections, to engage the parallel mounted switch plunger. In this manner operation of the actuator will cause the associated switch to operate in a manner similar to that outlined above. Similar modifications of the actuator for use with two-position locking type switches is also possible to permit operation of an associated parallel mounted pushbutton switch of the locking type.

The actuator device of the present inention may be utilized as a single unitary structure for operation of single pushbuttons or may be provided in a multiple form wherein actuators incorporating one or more of the variations described above, may be combined in a single structure having individual operating and stop portions but employing a common mounting section. Each actuator would then be individually hinged to the common mounting section. In such a manner both locking and nonlocking pushbutton switches and switches mounted in both vertical and horizontal planes may be operated by actuator mechanisms adjacent to each other and all flush mounted to the exterior surface of an associated enclosure.

DESCRIPTION OF THE PREFERRED EMBODIMENT

Figure 1:
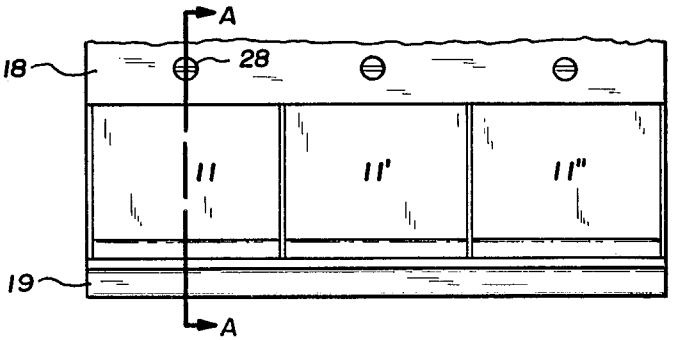
FIG. 1 is a top plan view of a pushbutton switch actuator device flush mounted in an associated enclosure and providing for operation of three pushbutton switches in accordance with the present invention.

Referring now to the accompanying drawing, a molded plastic pushbutton switch actuator is shown in FIG. 1 adapted for the operation of three pushbutton type switches. It should be understood, however, that the present invention is in no way limited to units for actuation of three switches but may be employed for single switches or any desired multiple thereof.

In FIG. 1 contact operating portions of actuator mechanisms for three associated switches are designated 11,11′ and 11″. A housing, enclosure or similar structure 18 is shown in part, to which actuators according to the present invention are mounted by one or more mounting devices such as 28. Also shown in FIG. 1 is a portion 19 of the housing, enclosure or structure to which the actuator is mounted that acts as a stop. This may be a portion of the same structure or housing 18 to which the actuator of the present invention is mounted.

Figure 2:
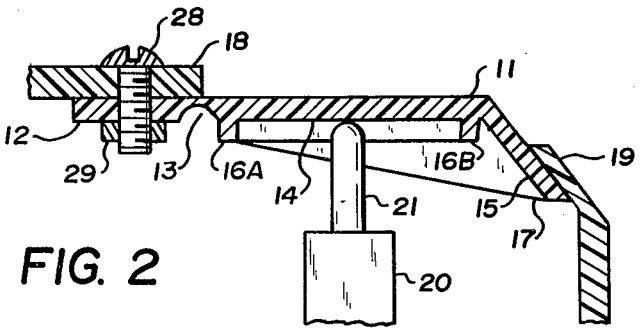
FIG. 2 is a sectional view taken along lines A—A of FIG. 1 and showing the actuator mechanism and an associated pushbutton switch in its normal or nonoperated position.

Referring now to FIG. 2, the details of the switch actuator 11 are shown. As may be seen, the actuator consists of a mounting or fixed portion 12 fastened to the underside of housing 18 by a mounting device consisting of bolt 28 and nut 29. Mounting portion 12 may be common to two or more actuators. Also included in the actuator is a hinge section 13 created by reducing the cross section thickness of the actuator between the mounting portion 12 and a contact portion 14. As may be noted, the contact portion 14 may be reinforced along its front and rear edges by reinforcing walls 16A and 16B. A stop engaging portion 15 projects forward from the upper surface of the actuator in such a manner as to engage stop 19 to inhibit any motion of the actuator in an upward direction from its normal position. The actuator also includes two sidewalls 17, one of which is shown, that extend along the sides from wall 16A to stop engaging portion 15. Shown in place, with its operating plunger 21 in an upward or nonoperated position is a nonlocking pushbutton switch 20.

Figure 3:
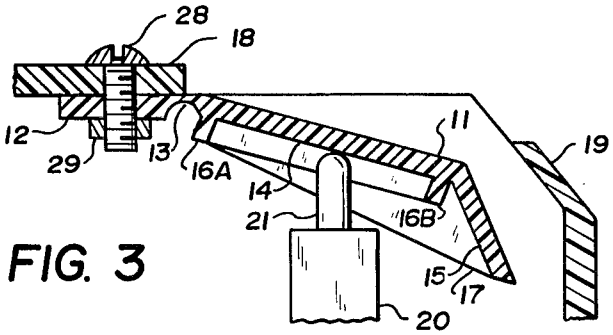
FIG. 3 is a sectional view taken along lines A—A of FIG. 1 and showing the actuator mechanism and an associated pushbutton switch in the operated position.

In response to manual operation, pressure is applied to the upper surface of the actuator 11 and particularly to contact portion 14 depressing it so as to assume the position shown in FIG. 3. Because of the relatively thin cross section that forms hinge portion 13, the structure flexes moving in a downward direction, forcing plunger 21 downward, operating associated nonlocking switch 20. On release of the actuator, the inherent spring present in plunger 21 of switch 20 will cause the actuator to return to its normal position as shown in FIG. 1. The stop 19 of the enclosure on meeting the stop engaging portion 15 of the actuator prevents travel of the switch and actuator beyond its normal position.

In another embodiment of the present switch actuator mechanism designed for use with locking type pushbutton switches, the actuator is molded normally in the configuration shown in FIG. 3. That is to say that the contact portion 14 is normally displaced angularly from the plane of the mounting portion. In locking type pushbuttons of conventional type, a portion of the plunger stays within the switch after operation as shown in FIG. 3 but on being depressed again returns to an extended or upward position in its nonoperated position as shown in FIG. 1. Thus, in the embodiment adapted for use with locking type pushbuttons the actuator lies in a plane parallel to the mounting section only when the pushbutton plunger is in its upward or nonoperated position and stays in the downward or angular position when the pushbutton switch plunger is in its downward or operated position. In this way it is visually apparent that the associated switch is operated or nonoperated as the case may be.

Figure 4:
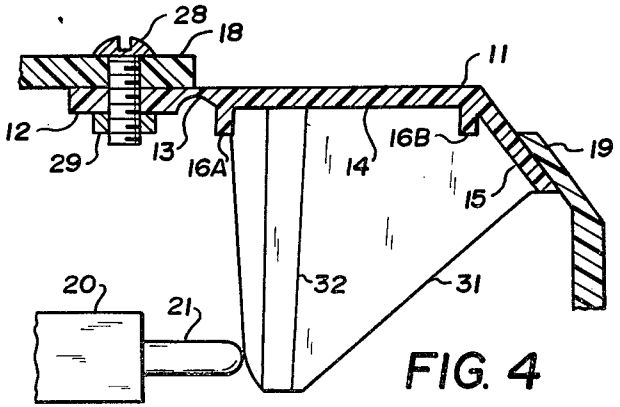
FIG. 4 is a sectional view taken along section A—A of FIG. 1 showing an alternate embodiment of an actuator in accordance with the present invention and an associated pushbutton switch, in the normal or nonoperated position.

Referring to FIG. 4, another embodiment of the present invention is shown wherein the associated pushbutton switch 20 has its plunger 21 in the same plane as the upper portion of the actuator 11 and further includes an extension 31 integrally molded with the actuator and so constructed as to act as a cam against which plunger 21 makes contact. While not necessary for practice of the present invention, a rib section 32 may be molded into the extension 31 to provide additional rigidity to the mechanism.

When the embodiment in FIG. 4 is manually operated, the extension portion 31 moves through a radius determined by the hinge 13 location, depressing plunger 21 of switch 20 to cause operation in conventional nonlocking pushbutton switches. When pressure is removed from the upper portion of actuator 11 it will return to its normal position in the manner previously described above allowing plunger 21 to restore the actuator and switch 20 to its nonoperated condition. As before, stop 19 contacting stop engaging section 15 of the actuator prevents travel beyond the normal position.

Figure 5:
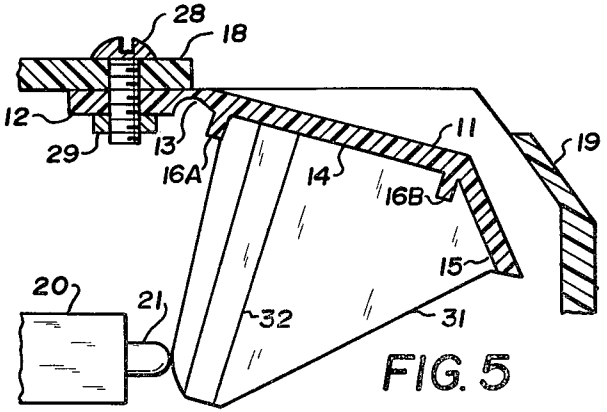
FIG. 5 is a sectional view taken along lines A—A of FIG. 1 of an actuator mechanism in accordance with the alternate embodiment of the present invention and including an associated pushbutton switch, in the operated position.

In another version of the present invention intended for use with locking type pushbuttons of the twoposition type, the actuator is molded in the configuration as shown in FIG. 5, cooperating with the associated switch 20 in a manner similar to that described above, assuming its normal position when the switch is operated and the plunger 21 is depressed after manual pressure has been applied to the actuator. Upon a second application of manual pressure the actuator returns to the upward position and is retained in that position in response to pressure applied by the plunger 21 of switch 20 in its nonoperated position.

When an actuator mechanism designed to accommodate a plurality of switches is employed in an environment wherein fewer switches are actually employed than the actuator is designed for, a rigid plate, arm rod, etc. can be fastened to the mounting device in such a manner as to extend beneath the actuator to block operation of the actuator.

When a number of switches are to be operated by adjacent actuators, the mounting section may be common to all adjacent actuators. Each actuator would then have its own hinge, contact position and stop engaging position. Any of the various embodiments above can be combined as required in such multiple actuator assemblies.

While only a limited number of embodiments of the present invention have been shown, it will be obvious to those skilled in the art that numerous modifications can be made without departing from the spirit of the present invention which shall be limited only by the scope of the claims appended hereto.

What is claimed is:

1. Actuator means for use with at least one pushbutton switch internally mounted within an associated enclosure, comprising a unitary structure constructed of plastic material and including:

a mounting section rigidly fastened to said enclosure, an operating section flush to the exterior of said enclosure adjacent to and in contact with said pushbutton switch;

and a hinge section connecting said operating section to said mounting section;

whereby said pushbutton switch is arranged to apply a force to said operating section retaining said operating section in a non-operated position and in response to the application of manual pressure to said operating section, said operating section is displaced to an operated position, to render said pushbutton switch operated.

2. Actuator means as claimed in claim 1 wherein: said mounting section and said operating section have substantially similar cross sectional dimensions and said hinge section has a cross sectional dimension substantially less than either said mounting section or said operating section.

3. Actuator means as claimed in claim 1 wherein: said actuator means further include a stop engaging section extending from said operating section and said enclosure includes a stop section positioned adjacent to said actuator stop engaging section and limiting the motion of said actuator means in a direction opposite that to which said manual pressure is normally applied.

4. Actuator means as claimed in claim 1 wherein: said pushbutton switch is of the nonlocking type and said pushbutton switch is located perpendicular to the operating section of said actuator means, whereby in response to the application of manual pressure in a first direction to said operating section said operating section is displaced from said non-operated position and said manual pressure is transmitted to said pushbutton switch to render said pushbutton switch operated, and upon release of manual pressure said pushbutton switch applies a force in a direction opposite to said first direction, thereby restoring said operating section to said non-operated position.

5. Actuator means as claimed in claim 1 wherein: said pushbutton switch is of the two-position locking type and said pushbutton switch is rendered nonoperated in a first locking position and operated in a second locking position;

said actuator means is constructed so that said operating section is angularly displaced from said mounting section; and whereby said operating section is non-operated and positioned flush to the exterior of said enclosure in response to a force from said pushbutton switch in said first locking position, and said pushbutton switch in response to a first application of manual pressure to said operating section is displaced to said second locking position rendering said operating section operated and said operating section positioned in angular displacement to said exterior of said enclosure, and said pushbutton switch in response to a second application of manual pressure to said operating section returns to said first locking position rendering said operating section non-operated.

6. Actuator means as claimed in claim 1 wherein: said operating section of said actuator means further includes a cam section extending from said operating section and making contact with said pushbutton switch.

7. Actuator means as claimed in claim 6 wherein: said pushbutton switch is of the nonlocking type; and whereby in response to the application of manual pressure to said operating section said operating section is displaced to said operated position and said manual pressure is transmitted in a first direction to said pushbutton switch by said cam to render said pushbutton switch operated, and upon release of manual pressure said pushbutton switch rendered non-operated and effective to apply a force to said cam in a direction opposite to said first direction thereby restoring said operating section to said non-operated position.

8. Actuator means as claimed in claim 6 wherein: said pushbutton switch is of the two-position locking type and said pushbuton switch is rendered nonoperated in a first locking position and operated in a second locking position;

said operating section of said actuator means is constructed angularly displaced from said mounting section; and whereby said operating section is non-operated and positioned flush to the exterior of said enclosure in response to a force from said pushbutton switch to said cam in said first locking position, and said pushbutton switch in response to said cam and to a first application of manual pressure to said operating section is displaced to said second locking position rendering said operating section operated and said operating section positioned in angular displacement to said exterior of said enclosure, and said pushbutton switch in response to a second application of manual pressure to said operating section returns to said first locking position rendering said operating section non-operated.

9. Actuator means as claimed in claim 1 wherein: there is further included at least one additional pushbutton switch said actuator means including individual operating sections and hinge sections, associated with each of said pushbutton switches and a mounting section common to all of said switches.

* * * * *